United States Patent [19]

Austill

[11] 4,076,166

[45] Feb. 28, 1978

[54] ROOF FOR RAILWAY CAR AND METHOD OF MAKING SAME

[75] Inventor: Robert J. Austill, Santa Clara, Calif.

[73] Assignee: FMC Corporation, San Jose, Calif.

[21] Appl. No.: 761,178

[22] Filed: Jan. 21, 1977

Related U.S. Application Data

[62] Division of Ser. No. 618,851, Oct. 2, 1975, Pat. No. 4,020,603.

[51] Int. Cl.[2] ..... B23K 31/10

[52] U.S. Cl. ..... 228/157; 52/53; 228/4.1; 113/116 W

[58] Field of Search ..... 113/1 R, 1 N, 1 M, 116 R, 113/116 V, 116 W; 228/4.1, 50, 157; 52/45, 46, 48, 50, 53, 56; 114/201 R

[56] References Cited

U.S. PATENT DOCUMENTS

| | | | |
|---|---|---|---|
| Re. 21,062 | 4/1939 | Thompson et al. | 52/53 X |
| 2,985,118 | 5/1961 | Maharick et al. | 52/53 X |
| 3,200,784 | 8/1965 | Gowan | 114/201 R |
| 3,788,634 | 1/1974 | Chauvet et al. | 228/50 X |
| 3,823,518 | 7/1974 | Allen | 52/53 |

*Primary Examiner*—Leon Gilden
*Attorney, Agent, or Firm*—A. J. Moore; C. E. Tripp

[57] ABSTRACT

A unitary, prefabricated railway car roof and its method of manufacture. Two elongated flat webs of galvanized sheet metal disposed in edge to edge abutting relation, and having a combined width slightly greater than the width of the finished roof, are preferably unwound from rolls and are intermittently moved through a welding station which bonds the two webs together into a single wide sheet. Downstream of the welding station the sheet is fed through dies of a hydraulic stamping press which form transverse corrugations at approximately two foot intervals in the combined sheet to provide stiffening panels extending substantially the full width of the roof, and at the same time to form a gable with the longitudinal weld line being the crest of the gable and defining the longitudinal centerline of the roof. In the finished roof, the stiffening panels cooperate with conventional end and side walls of a railway car to support the roof structure, and the peripheral edge portions of the roof are either welded or riveted to the upper end and side plates of the car.

8 Claims, 10 Drawing Figures

FIG_1A
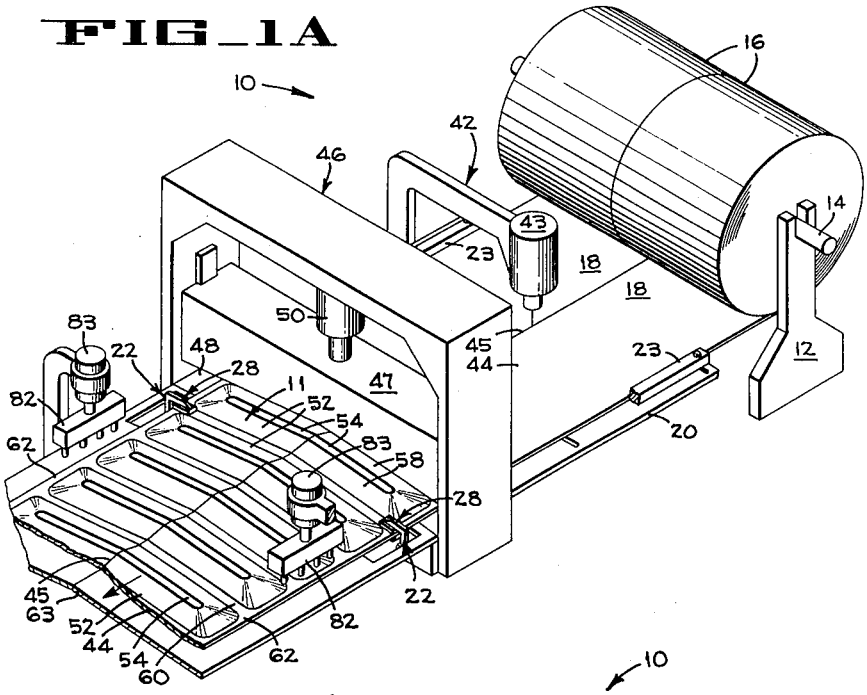
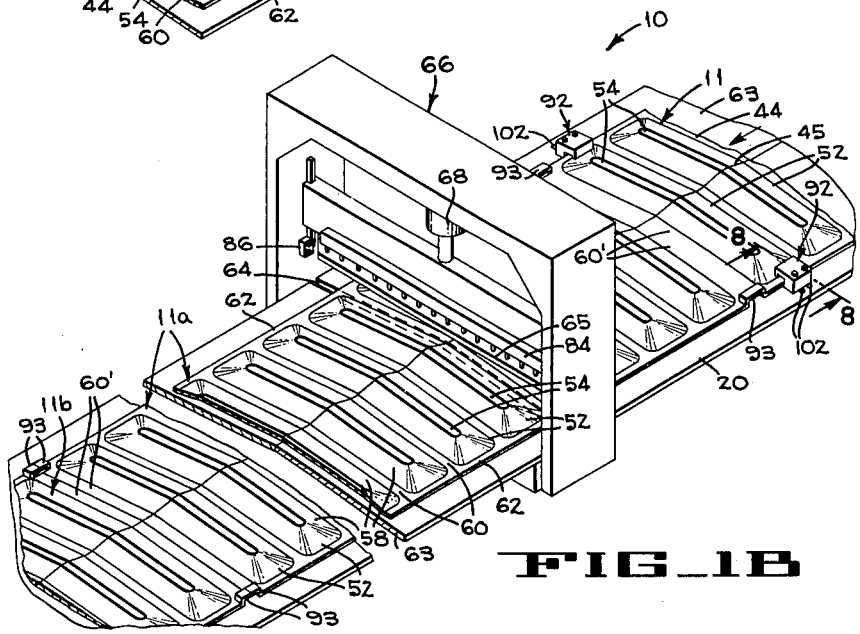
FIG_1B

ROOF FOR RAILWAY CAR AND METHOD OF MAKING SAME

This is a division, of application Ser. No. 618,851 filed Oct. 2, 1975, now U.S. Pat. No. 4,020,603.

BACKGROUND OF THE INVENTION

1. Field of the Invention

This invention pertains to railway cars, and more specifically relates to a unitary roof for a railway car, and the method of its manufacture.

2. Description of Prior Art

During the many years that railway cars, and particularly box cars, have been manufactured, many of the details and practices during manufacture have undergone very little change. In the case of box car roofs, many of the prior art roofs are made from a plurality of separate roof panels, a number of which are required to span the length of the railway car and are welded or riveted together and to the upper surfaces of the side and end walls of the car to form the completed roof.

Early patents disclosing these general concepts are Jennings Ser. No. 696,976 which issued on Apr. 8, 1902; Russell U.S. Pat. No. 1,186,841 which issued on June 13, 1916; Small U.S. Pat. No. 1,681,813 which issued on August 28, 1928; and Bonsoll, U.S. Pat. No. 2,034,378 which issued on May 17, 1936. In each of these patents, a series of roofing panels transversely span a railway car and must be rigidly interconnected to each other and to the car frame. In the Bonsall patent, the roof panels are welded together, and in the earlier patents the panels are riveted or crimped together.

The welded type of car roof is now predominant and further development of this type of roof may be seen in patents such as Shaver U.S. Pat. No. 2,519,079 which issued on Aug. 15, 1950; Cisco U.S. Pat. No. 3,263,379 which issued on Aug. 2, 1966; and Allen et al U.S. Pat. No. 3,408,779 which issued on Nov. 5, 1968. In the Shaver patent the roof is fabricated at a location away from the car to form a unitary roof structure which can then be installed in completed, or nearly completed condition on the car. Shaver employs transverse panels in conjunction with other framing members, and the main advantage is that the roof is more easily assessible for the welding operations when it is assembled off the car.

A common feature in the above listed patents is that each roof comprises a series of similar panels which must not only be fastened to the upper side plates and end plates of the railway car walls, but must also be laboriously fastened to each other. It is apparent that a roof system which will shorten the installation time and reduce the amount of labor required will have a marked commercial advantage; the present invention provides this, or other advantages over other ordinary railway car roofing systems.

SUMMARY OF THE INVENTION

A basic aspect of the present invention is that a railway car roof which is formed by welding only two webs of sheet metal together and pressing corrugated stiffening panels therein is less complex and more adaptable than the known prior art roofs. The so fabricated roof is thereafter installed on the railway car as a unit by the car builder. When forming a roof as described herein, both the initial roof fabrication cost and the installation time and labor are considerably reduced. Also, the roof is more adaptable for use as a regular stock item along with frames, wheels, axles and other stock railway car components which may thereafter be combined at final assembly to provide the finished railway car.

In accordance with the present invention the roof is preferably formed from two webs of sheet material intermittently unwound from rolls of sheet metal that are rotatably mounted side by side. The unwound coplanar webs abut along a centerline and cooperatively measure, normal to the centerline, slightly more than the width of the finished roof. Adjacent the rolls, an automatic welding machine at a welding station produces a continuous ductile weld along the centerline to form an integral sheet from the webs. Further downstream, the integral sheet is fed through a stamping press forming a longitudinal gable at the weld line and also forming upwardly offset corrugations or stiffening panels at longitudinally spaced intervals which extend transversely of the sheet substantially the full width of the roof. When a roof-length (about 50 feet) of the sheet has been intermittently advanced and stamped, a shear transversely severs the sheet in the area between adjacent stiffening panels to complete the roof (except for cleanup such as degreasing and painting) for subsequent installation on the railway car.

Although the completed roof is preferably welded to the upper side plates and end plates of the car walls, some car manufacturers prefer to rivet the roof to the car. In the case of roofs installed with rivets, punching operation perforates both longitudinal edge portions of the roof while the stamping operations are being carried out; and similar rivet holes are likewise punched into the end portions of each panel by punches positioned on the sides of the shear. Whether the roofs are to be installed by riveting or welding, it is apparent that they may first be manufactured and stored; and thereafter each one piece roof may be rapidly attached to the upper surfaces (or plates) of the side and end walls of the associated car with a minimum expenditure of time.

In accordance with the present invention, a unitary railway car roof comprises two elongated sheet metal webs extending the full length of the roof and cooperatively form a symmetrical gable in cross section, a continuous weld joins the webs along the crest of the gable, and a plurality of longitudinally spaced stiffening panels are integrally stamped in the webs and extend substantially the full width of the roof and through the weld.

Also in accordance with the present invention a method is provided for manufacturing a one piece roof for installation as a unit on the upper side plates and end plates of a railway car, the method comprising the steps of: drawing two elongate flat webs of sheet metal in abutting relation along a given path; welding the abutting longitudinal edges between the webs together at a welding station forming a seam as the webs are drawn along the path to form a one piece sheet approximately the width of a railway car; forming a gable cresting substantially along the seam; transversely deforming a selected longitudinal area of said sheet at a location closely spaced from said welding station, said deforming producing a stiffening panel offset from the normal plane of said sheet; repetitively advancing and deforming said sheet to form a plurality of integral longitudinally spaced stiffening panels therein; and transversely severing the thus formed unitary gabled roof along a line in a non-deformed portion so that the roof approximates the length of a railway car.

BRIEF DESCRIPTION OF THE DRAWINGS

FIGS. 1A and 1B when combined form a diagrammatic perspective, partly broken away, of a preferred embodiment of an apparatus employed in performing the method of the present invention, and further illustrating portions of two railway car roofs constructed in accordance with the present invention.

DESCRIPTION OF THE PREFERRED EMBODIMENT

Figure 2:
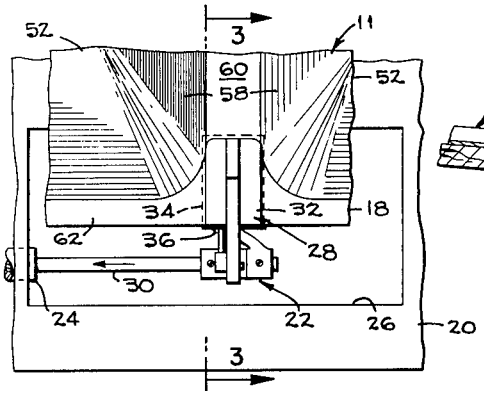
FIG. 2 is a schematic plan of a feed mechanism for intermittently advancing the roof through the roof forming system.

FIGS. 1A and 1B diagrammatically illustrates a preferred roof forming system 10 for carrying out the method steps in forming unitary roofs 11,11*a*,11*b* for a railway car in accordance with the present invention. A typical 70 ton freight box car may have a roof length of approximately 50 feet and a width of about 9½ feet.

The roof forming system 10 includes an unwind stand 12 having a support shaft 14 which rotatably carries two side by side rolls 16 of sheet metal, preferably about 14 gauge galvanized stock, which is supplied by the mill in rolls of several tons each that will provide for relatively long term operation of the roofing system.

The two webs 18 are drawn from the roll 16 and are intermittently fed over a feed table 20 by any conventional intermittently actuated feed mechanism 22 which cooperates with guide rails 23. A suitable type of web feed mechanism 22 (FIGS. 2 and 3) includes a pair of the mechanisms 22 with one of the mechanisms disposed at each longitudinal edge of the web as diagrammatically illustrated in FIG. 1. Each feed mechanism 22 includes a hydraulic power unit 24 mounted below the table 20 adjacent a longitudinal opening 26 therein. A scissors type clamp mechanism 28 is carried by the piston rod 30 of the power unit 24, with one clamp jaw 32 being pivoted to the rod and the other clamp jaw 34 being rigid therewith. A clamp actuating hydraulic power unit 36 is connected between the two clamp jaws, and when actuated serves to firmly grip the adjacent edges of the webs 18. The jaws preferably grip the webs between corrugations formed therein but if desired may be positioned to grip the webs prior to having corrugations formed therein. Also, in its simplest form, the hydraulic power units 24 and 36 may be actuated by manually operating standard controls (not shown) to clamp and thereafter intermittently advance the webs 18 the desired distances. However, it will be understood that automatic controls may also be provided.

The two feed mechanisms 22 and cooperating guide rails 24 initially effect movement of the webs 18 into edgewise abutting and coplanar relationship, and intermittently advance the webs past a welding station 42 where a welder 43 welds the abutting edges of the webs together thereby forming a one piece web or sheet 44. It is important that the weld material be ductile when cooled if the welder precedes a stamping press 46 as illustrated in FIG. 1A since the linear longitudinal central seam 45 as well as adjacent areas of the one sheet 44 are deformed by the stamping press 46.

The stamping press 46 includes a power-actuated upper die 47 which reciprocates vertically toward and away from a fixed lower die 48. The confronting faces (not shown) of the upper and lower dies are respectively raised and recessed, and the die profiles as viewed along the length of the sheet 44 cooperatively define a gable with its crest coincident with the weld or seam line 45. Thus, each powered lowering of the upper die 47 by a hydraulic cylinder 50 forces the sheet 44 against the lower die 48 and forms an upwardly offset transverse stiffening panel or corrugation 52.

Figure 3:
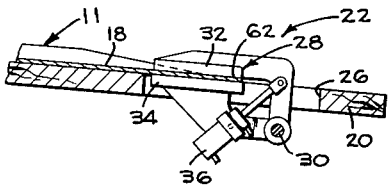
FIG. 3 is a section taken along lines 3—3 of FIG. 2 illustrating a roof clamping mechanism of the feed mechanism.
Figure 6:
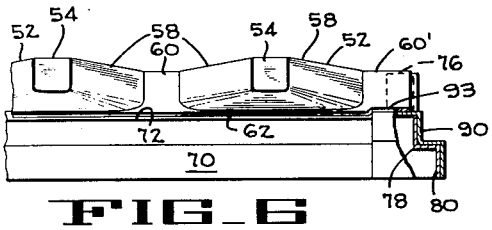
FIG. 6 is a side elevation looking in the direction of arrows 6—6 of FIG. 4, a fragment of the corner of the railway car being cut away.
Figure 4:
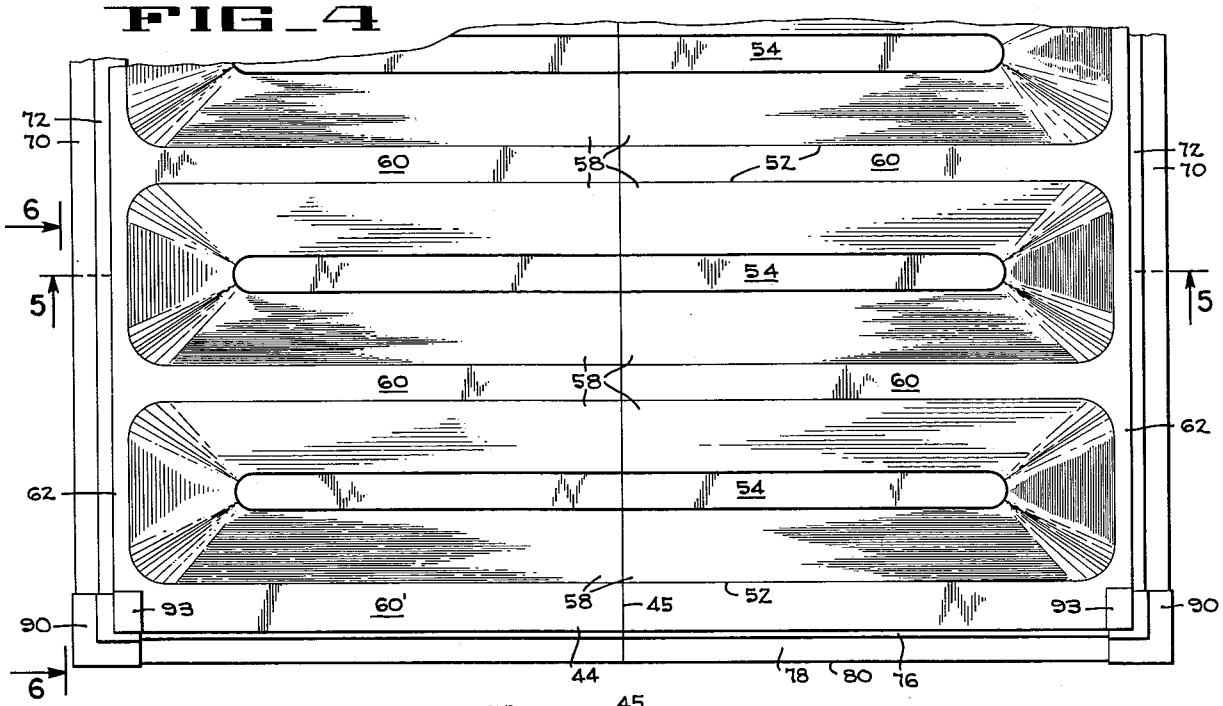
FIG. 4 is a plan of a fragment of the roof welded to the side walls and an end wall of the railway car.
Figure 5:
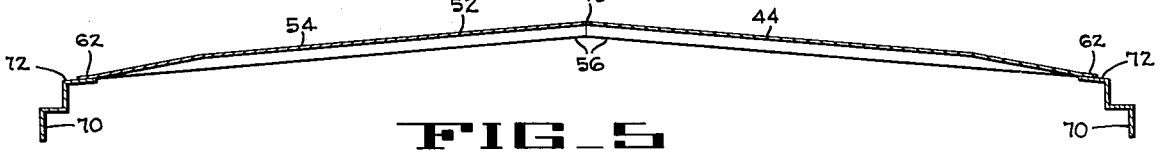
FIG. 5 is a vertical section taken along lines 5—5 of FIG. 4 illustrating the gabled configuration of the roof.

As shown in FIGS. 4–6, the preferred longitudinal and transverse configuration of each stiffening panel 52 provides a flat, raised central portion 54 which slopes downward at each side of the longitudinal weld seam at 45, on the peak of the roof, with about a 1:12 pitch. Each central portion 54 is only about an 1½ inches above, and parallel to, the general plane or normal lower surface of the roof as indicated by the numeral 56. Sloping panels 58 (FIGS. 4, 6 and 7) which sloping from each side of the raised central portion 54 merge with transversely extending flat roof portions 60 disposed between successively stamped panels 52; and also merge with longitudinal edge portions 62 of the roof which are coplanar with the adjacent transverse portions 60 as illustrated in FIG. 3. Thus, each stiffening panel 52 is formed across substantially the entire unsupported width of the roof and such panels 52 and the gables profile are formed simultaneously.

It will be noted that the portion of the table 20 upstream of the welding station 42 (FIG. 1A) is flat. It will be understood that downstream of the welding station the table 20 gradually assumes the gabled configuration of the lower die 48 as illustrated at 63, thereby preventing buckling of the web upstream of the press 46 during the stamping operation. The gabled portion 63 of the table 20 is transversely slotted at 64 below the blade 65 of a shear 66 to permit a completed roof section to be sheared from the sheet 44. The shear blade 65 is reciprocated by a hydraulic cylinder 68. The completed car roof 11 may then be nested with other roofs for interim storage and eventual use on site or for shipment to a purchaser.

It will be evident that the plurality of stiffening panels or corrugations 52 formed by the stamping dies 47 and 48 are integral with each other and require no welding. It is also evident that the intervening flat sections 60 between the panels, when added to the lengths of the plurality of stiffening panels equals the required roof length, and the roofs can be made for cars of different lengths merely by altering the widths of the flat sections 60 by controlling the stroke of the intermittent drive mechanisms 22 while using the same stamping dies. In the particular example given, the center to center distance between the flat sections 60 is 24 inches, and 25 stiffening panels 52 plus an extra margin of 3¼ inches added to the end sections 60' provide a roof that is 50 feet, 6½ inches long. Obviously, the roof can also be altered from the above dimensions while using the same dies by; selectively changing the number of stiffening panels 52, changing the dimensions of the flat sections 60, and/or changing the dimensions of the extra end margins above mentioned. To alter the roof width, the proper width rolls 16 must first be selected and then the flat marginal edges 62 must be either enlarged or reduced in width if the same stamping dies are to be used.

As shown in FIGS. 4–6, in one type of roof installation for a railway car having side walls with the upper side plates 70 being Z-shaped, the longitudinal edge portions 62 of the roof 11 are welded to the inturned upper lateral flanges 72 of the side plates 70. The end edges 60' of the roof are welded to upper inturned flanges 76 (FIG. 6) of gabled Z-plates 78 of the two end walls 80 (only the upper fragment of one end wall being shown).

Figure 9:
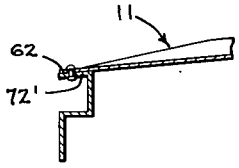
FIG. 9 is a fragmentary section illustrating a modified upper flange of a side wall of the railway car for a riveted roof construction.
Figure 7:
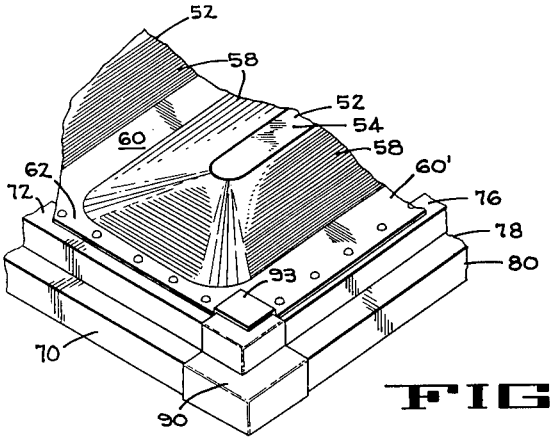
FIG. 7 is a perspective of one corner of a modified form of roof having rivet holes punched therein and shown riveted to the railway car.

If the roof attachment is made by riveting as opposed to welding, mating rivet holes are punched in the peripheral edge portions 60',62 of the roof as indicated in FIG. 7, and in associated upper inturned flanges 72,76 of the railway car, and are subsequently riveted together. However, when riveting the roof to a car, it is preferable that the upper flanges 72,76 (FIG. 7) be of the outwardly turned type, rather than the inwardly turned type as indicated at 72' in FIG. 9 so that a single person may do the riveting of the lateral edge portions of the roof entirely from the outside of the railway car.

For forming the rivet type of roof, multiple punches 82 (FIG. 1A) are positioned along both sides of the table 20, are activated by hydraulic cylinders 83 to punch a series of rivet holes when the sheet 44 is being held stationary for the stamping operation. Since the roofs may be manufactured for sale to several different railway car manufactures, and since some of the manufacturers may weld the roof to the railway car, and not require any rivet holes, while others may have different rivet spacing requirements; it is desirable that the punches 82 be separately operable from the stamping press 46 in order to punch the rivet holes in the side plates in accordance with the varying requirements.

In order to provide rivet holes in the end edge portions 60' of the roof, two sets of punches 84 (only one set being shown in FIG. 1B) may be mounted to opposite sides of the blade 65 of the shear 66. If the roof is not to be provided with rivet holes, the downward stroke of the shear blade 65 is limited by abutment blocks 86 (only one being shown) which permits shearing the sheet 44 but does not allow the punches 84 to move far enough downwardly to engage the roof. If rivet holes are to be provided, the blocks 86 are removed and the stroke of the piston 68 is increased so that the sheet 44 is sheared and both adjacent end portions 60' are provided with rivet holes.

Figure 8:
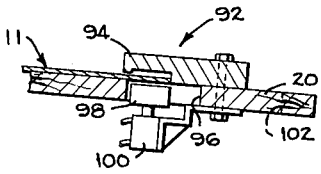
FIG. 8 is a section taken along lines 8—8 of FIG. 1B illustrating a corner upsetting die.

Many railway cars are provided with corner caps 90 (FIGS. 4, 6 and 7) on each of the upper corners to rigidly secure the side walls to the end walls. Since the upper surfaces of these corner caps 90 usually project above the upper surfaces of the side plate flanges 72 and end plate flanges 76, a pair of corner presses 92 (FIGS. 1B and 8) are provided for upsetting the four corners as indicated at 93 of each roof to accommodate the corner caps 90, Each corner press comprises a stationary die 94 secured to the table 20 above an aperture 96 formed therein, and a movable die 98. The movable die 98 is actuated by a hydraulic power unit 100 that may be controlled manually to bend the four corners of each roof upwardly as required. The dies 94 and 98 are preferably bolted to the table 20 through slots 102 to permit transverse adjustment of the dies to accommodate roofs of different widths.

Although in the preferred embodiment of the invention the automatic welder 43 is disposed upstream of the stamping press 46, it will be understood that the welder 43 may be disposed downstream of the press if desired thereby avoiding the necessity of using ductile welding rod. Also, it will be understood that the roofs may each be formed from a pair of precut sections of sheet metal, as opposed to drawing the uncut metal from rolls. For example, if a customer requires that the roofs be made of a heavier gauge sheet metal than is normally used, it may be necessary to purchase the two sheet metal panels for each roof in sheet, rather than in roll form.

From the foregoing description it is apparent that the roof of the present invention, and the method of making the same, provides for a sturdy roof made from only two elongated webs of sheet metal welded together at a longitudinal seam. Stiffening panels (or corrugations) are stamped at even intervals into the roof thus minimizing fabrication costs. The one piece roof may be made on a mass production basis, with or without rivet holes, and in many different sizes to accommodate different types of railway cars.

Although the best mode contemplated for carrying out the present invention has been herein shown and described, it will be apparent that modification and variation may be made without departing from what is regarded to be the subject matter of the invention.

I claim:

1. A method of manufacturing a one piece roof from two longitudinally elongated webs of sheet metal for installation as a unit on the upper side plates and end plates of the walls of a railway car, said method comprising the steps of: drawing two elongate flat webs of sheet metal in abutting relation along a given path; welding the abutting longitudinal edges between said webs together at a welding station forming a seam as the webs are drawn along said path to form a one-piece sheet approximately the width of a railway car; forming a gable cresting substantially along the seam; transversely deforming a selected longitudinal area of said sheet at a location closely spaced from said welding station for providing a stiffening panel offset from the normal plane of the sheet; repetitively advancing and deforming said sheet to form a plurality of integral longitudinally spaced stiffening panels therein; and transversely severing the thus formed unitary gabled roof along a line in a non-deformed portion so that the roof approximates the length of the railway car.

2. A method according to claim 1 wherein said step of drawing said webs includes the step of unwinding the webs from adjacent rolls of sheet metal.

3. A method according to claim 1 wherein said step of drawing the webs along a given path imparts intermittent motion to the webs.

4. A method according to claim 1 wherein ductile welding rod is used in said step of welding said webs, and wherein said welding step occurs prior to transversely deforming the webs.

5. A method according to claim 1 wherein each of said stiffening panels is upwardly offset during said transverse deforming step and wherein said transverse deforming step is also effective to form sloping panels which slope from said stiffening panel to the general plane of said sheet after being gabled.

6. A method according to claim 1 and additionally including the step of forming rivet holes in the longitudinal and transverse edge of the roof.

7. A method according to claim 1 and additionally including the step of upsetting all four corners of the roof.

8. A method according to claim 1 wherein said repetitive advancing and deforming steps simultaneously deform the sheet to form a gable extending the full length of the sheet while forming the plurality of integral longitudinally spaced stiffening panels therein.

* * * * *

UNITED STATES PATENT AND TRADEMARK OFFICE

CERTIFICATE OF CORRECTION

PATENT NO. : 4,076,166

DATED : February 28, 1978

INVENTOR(S) : Robert J. Austill

It is certified that error appears in the above—identified patent and that said Letters Patent is hereby corrected as shown below:

Col. 5, line 38, change "manufactures" to --manufacturers--

Col. 5, line 64, change "1B" to --1A--

Signed and Sealed this

Tenth Day of June 1980

[SEAL]

Attest:

SIDNEY A. DIAMOND

Attesting Officer

Commissioner of Patents and Trademarks